US005642138A

United States Patent [19]

Hijikata

[11] Patent Number: 5,642,138

[45] Date of Patent: Jun. 24, 1997

[54] DISPLAY CONTROL SYSTEM USING A DIFFERENT CLOCK IN THE GRAPHICS MODE FROM THAT IN THE TEXT MODE IN ACCESSING AN IMAGE MEMORY

[75] Inventor: Keijirō Hijikata, Tokyo, Japan

[73] Assignee: Kabushiki Kaisha Toshiba, Kawasaki, Japan

[21] Appl. No.: 255,938

[22] Filed: Jun. 7, 1994

[30] Foreign Application Priority Data

Jun. 18, 1993 [JP] Japan ..... 5-147984

[51] Int. Cl.[6] ..... G09G 5/00

[52] U.S. Cl. ..... 345/200; 345/190; 345/193; 345/213; 345/116

[58] Field of Search ..... 345/189, 190, 345/192, 193, 116, 213, 200

[56] References Cited

U.S. PATENT DOCUMENTS 3,609,666 9/1971 Kamm .
4,663,735 5/1987 Novak et al. ..... 345/190
4,757,309 7/1988 Bowater et al. ..... 345/114
5,483,257 1/1996 Otake et al. ..... 345/192

*Primary Examiner*—Richard Hjerpe
*Assistant Examiner*—Juliana S. Kim
*Attorney, Agent, or Firm*—Oblon, Spivak, McClelland, Maier & Neustadt, P.C.

[57] ABSTRACT

Depending on whether the display mode specified by a CPU is the graphics mode or the text mode, the access mode of an image memory is switched. In the text mode, a random access is executed in a single read cycle with the timing synchronizing a video clock to alternate the reading of character codes and attributes with the reading of character fonts on a character basis. This makes shorter the time that the image memory is occupied for screen refreshing, thereby making so much longer the drawing time of the CPU. Furthermore, because an entire display controller functions as a video clock synchronizing circuit, the function of synchronizing the circuits is not necessary, which results in simplified control.

8 Claims, 6 Drawing Sheets

DISPLAY CONTROL SYSTEM USING A DIFFERENT CLOCK IN THE GRAPHICS MODE FROM THAT IN THE TEXT MODE IN ACCESSING AN IMAGE MEMORY

BACKGROUND OF THE INVENTION

1. Field of the Invention

The present invention relates to a display control system of a personal computer, and more particularly to a display control system with two display modes of a graphics mode and a text mode.

2. Description of the Related Art

Generally, a display controller of a personal computer has two display modes: a graphics mode and a text mode. The graphics mode is a mode in which image data stored in an image memory is displayed on a display monitor of a computer. The text mode is a mode in which character fonts are displayed on the display monitor according to the arrangement of character codes in the image memory. In both of the graphics and text modes, the data read from the image memory is converted into a video signal by a display control circuit in the display controller and then is supplied to the display monitor. In this case, the display control circuit operates in synchronization with a video clock. The video clock is a synchronizing signal used to supply a video signal in dots to the display monitor. The frequency of the video clock is determined by the display timing of the display monitor.

Accessing the image memory is controlled by a memory control circuit in the display controller. The accesses of the memory control circuit to the image memory include accesses for the CPU to draw pictures and those for reading the data from the image memory to refresh the screen.

The higher the resolution of the display screen becomes, the larger the amount of data that must be read from the image memory. Particularly, in the case of graphics data, the number of bits per dot is large, so that it takes a lot of time to read the data from the image memory.

In this case, since the time that the image memory is occupied to refresh the screen becomes longer, this limits the time that the CPU can use the image memory to rewrite the data in the image memory. This is the main cause of a deterioration in the drawing performance of the CPU.

Accordingly, to improve the speed at which data is read from the image memory in the graphics mode, recent display controllers use a page-mode read cycle and a memory clock for memory control only.

The page-mode read cycle is a serial access mode in which a plurality of data items stored consecutively at row addresses in the image memory are read out consecutively. Use of this mode enables a large number of graphics data items to be read from the image memory at high speed.

Since the frequency of the memory clock can be determined only by the performance of the image memory independently of the frequency of the video clock, the former can be set higher than the latter. Therefore, using the memory clock to drive the memory control circuit enables the graphics data to be read from the image memory at higher speed.

Consequently, use of the page-mode read cycle and the memory clock shortens the time that the image memory is occupied to refresh the screen in the graphics mode, so that the CPU can spend so much longer time in drawing pictures.

With conventional display controllers, however, serial access to the image memory using such a page-mode memory cycle and a memory clock is effected regardless of whether the graphics mode or the text mode is active.

This accessing technique has the disadvantage of increasing the reading speed in the graphics mode, but decreasing it in the text mode to the contrary.

Hereinafter, referring to FIGS. 1 and 2, an image memory access operation will be described which uses a page-mode read cycle and a memory clock in the text mode.

FIG. 1 conceptually shows the configuration of the memory control circuit which provides access control of the image memory. FIG. 2 is a timing chart illustrating access timing of the image memory.

In the text mode, among four maps (MPA0 to MAP3) constituting the image memory 50, MAP0, MAP1, and MAP2 are used, and MAP3 is not used. MAP0 stores character codes (Code), MAP1 stores attributes (ATT), and MAP3 stores character fonts (Font).

When the text data is displayed on a display monitor, MAP0 and MAP1 in the image memory 50 first undergo serial access in a page-mode read cycle. In the page-mode read cycle, a plurality of column addresses CA are generated consecutively for a single row address RA and then supplied to MAP0 and MAP1. Then, character codes are read consecutively from MAP0 and attributes are read consecutively from MAP1. These character codes and attributes are written into an FIFO buffer 57 one after another.

Once the FIFO buffer 57 gets full, the character codes and attributes are read from the FIFO buffer 57 and then latched in latch circuits 59, 60, respectively. The latched character code is used as a font address for accessing MAP2.

Then, a single read cycle using the font address is executed, and row address RA and column address CA corresponding to the font address are supplied to MAP2. Thus, MAP2 is random-accessed in a single read cycle, with the result that as much font data as one raster of the character font pattern specified at the font address is read out. This font data is latched in a latch circuit 61. With the same timing, the attribute in the latch circuit 60 is transferred to a latch circuit 62 and then latched there. Thereafter, according to the font data and attribute, video data is generated dot by dot.

As explained above, in the text mode, accessing MAP0 and MAP1 must be effected in a page-mode read cycle and thereafter, MAP2 must be accessed in a single read cycle. The single read cycle is repeated as many times as the number of character codes consecutively read in the page-mode read cycle. Therefore, the larger the number of character codes read in the page-mode read cycle becomes, the longer the execution period of the single read cycle lasts.

During the execution period of a single read cycle for MAP2, a page-mode read cycle for MAP0 and MAP1 cannot be executed. The reason for this is that since each page-mode read cycle is relatively long, it is impossible to insert a page-mode cycle into a vacant time in the single read cycle.

Consequently, in the text mode, using a page-mode read cycle makes the time very long for which only MAP2 is being accessed in a single read cycle. This therefore results in a decrease in the data reading speed.

Since a conventional image memory is subjected to serial access regardless of whether the display mode is the text mode or the graphics mode, a random access must be repeated many times to read character fonts after a page-mode read cycle has been executed to read the character code and attribute. In this case, the next page-mode read cycle is not executed until the reading of the character fonts corresponding to all the character codes read in the page-mode read cycle has been completed. This introduces the disadvantage that the time for which the image memory is occupied for data reading becomes longer, and consequently the time for which the CPU provides control of the image memory becomes shorter.

SUMMARY OF THE INVENTION

An object of the present invention is to provide a display control system which can implement a sufficient drawing capability by switching the access mode of the image memory, depending on whether the display mode is the graphics mode or the text mode, in order to always assure optimum access to the image memory.

The foregoing object is accomplished by providing a display control system comprising: an image memory storing either text data and character fonts or graphics data; display mode discriminating means for discriminating whether the display mode specified by a host CPU is a graphics mode or a text mode; memory control means, controlled on the basis of the discrimination result of the display mode discriminating means, for, in the graphics mode, executing a serial access in a page mode to consecutively read a plurality of graphics data items stored in address order in the image memory, and in the text mode, executing a random access to alternately read the text data items and character fonts stored in the image memory; and display control means for converting the data read by the memory control means from the image memory into video data and outputting the video data to a display.

With this display control system, the access mode of the image memory is switched, depending on whether the display mode is the graphic or the text mode. Only in the graphics mode, a serial access is executed in a page-mode read cycle, whereas in the text mode, a random access is executed in a single read cycle. In the random access, the reading of character codes and attributes and that of character fonts are effected alternately on a character basis. This shortens the time for which the image memory is occupied to refresh the screen in the text mode, thereby making so much longer the time for which the CPU draws pictures.

Therefore, an image memory access suitable for the display mode can be effected, thereby enabling data to be read from the image memory at higher speed even in the text mode. As a result, the time for which the CPU can control the image memory for drawing is increased, thereby improving the drawing capability.

The display control system of the present invention has the second advantage that in the text mode, the input clock to the memory control means is switched from the memory clock to the video clock, and the image memory can be random-accessed with the timing synchronized with the video clock.

In the text mode, the image memory is random-accessed. In this case, the drawing time of the CPU is not much different between use of the memory clock and use of the video clock. For this reason, the display control system uses the video clock in the text mode. When the video clock is used, since the timing of reading the data from the image memory coincides with the timing of operating the display control means, it is not necessary to provide a data buffer and related circuits for synchronization, which results in simplified control. In addition, because the memory clock generator means can be disabled, the more power consumption can be decreased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention in which.

DETAILED DESCRIPTION OF THE PREFERRED EMBODIMENTS

Figure 1:
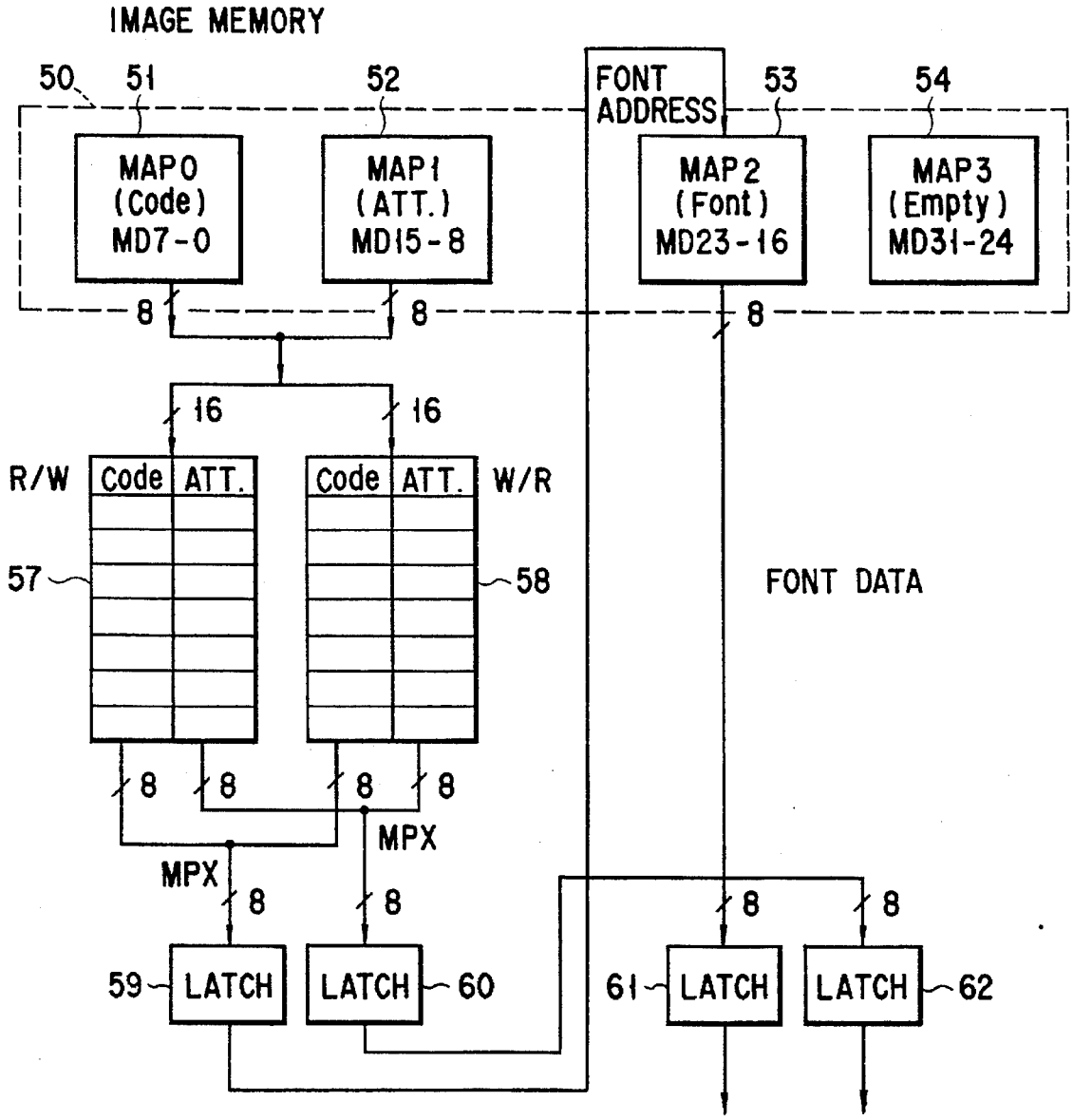
FIG. 1 (PRIOR ART)
FIG. 1 is a circuit diagram of a memory control circuit in a conventional display control system.

Hereinafter, referring to the accompanying drawings, an embodiment of the present invention will be explained.

The overall configuration of a display control system associated with an embodiment of the present invention will be described with reference to FIG. 3. The display control system 4 complies with, for example, VGA (Video Graphics Array) specifications including a display mode of 640×480-dot 256-color display, and is connected via a bus connector 3 to a system bus 2 of a portable computer. The display control system 4 provides display control of both of a flat panel display 40 which is equipped as a standard in the portable computer main body and a color CRT display 50 optionally connected.

The display control system 4 is provided with a display controller 10 and an image memory 25. These display controller 10 and image memory 25 are mounted on a circuit board (not shown).

The display controller 10 is an LSI implemented by a gate array and constitutes a main portion of the display control system 4. The display controller 10 is connected to a CPU 1 of the portable computer by way of the bus connector 3 and the system bus 2 and draws a picture in the image memory 25 in response to a request of the CPU 1. The display controller 10 converts the data drawn in the image memory 25 into video data and supplies the same to the flat panel display 40 or the color CRT display 50 in order to refresh the screen.

The image memory 25 stores the display data to be displayed on the flat panel display 40 or the color CRT display 50, and comprises, for example, two DRAM chips. In the image memory 25, four maps (MAP0 to MAP3) are defined. MAP0 and MAP1 are implemented by one DRAM, and MAP2 and MAP 3 are implemented by the other DRAM.

The image memory 25 has a 32-bit data input/output port corresponding to memory data MD31-0. In this case, MAP0, MAP1, MAP2, and MAP3 correspond to memory data MD7-0, MD15-8, MD23-16, and MD31-24, respectively. These MAP0 to MAP3 are addressed in common by memory addresses (MA9 to MA0).

There are provided two sets of memory control signals (row address strobe signal RAS, column address strobe signal CAS, write enable signal WE, and output enable signal OE): ARAS, ACAS, AWE, and AOE are used as control signals to one DRAM implementing MAP0 and MAP1, and BRAS, BCAS, BWE, and BOE are used as control signals to the other DRAM implementing MAP2 and MAP3.

In the graphics mode, graphics data is drawn onto the image memory 25 by a memory plane technique. The memory plane technique is a method which uses all of the four maps (MAP0 to MAP3) and allocates color information on each pixel to those maps. In this case, a single pixel is expressed by a total of four bits of data (four bits/pixel), one bit for each map. Because the data input/output port of the image memory 25 has a width of 32 bits, eight dots of graphics data of four bits/pixel are read out in a read access.

In the text mode, character codes, attributes, and character font data are stored in the image memory 25. Also in this mode, three maps (MAP0 to MAP2) of the four maps (MAP0 to MAP3) defined in the image memory 25 are used. A screen of character codes to be displayed is stored in MAP0, and a screen of attributes corresponding to those codes is stored in MAP1. A character of text data has a data size of a total of two bytes consisting of eight bits of character code and eight bits of attribute. The 8-bit attribute data contains 4-bit data (bit0 to bit3) specifying the foreground color (character color) and 4-bit data (bit4 to bit7) specifying the background color. Of 4-bit data (bit0 to bit3) specifying the foreground color, data of bit3 is also used to select the type of character or to specify the high luminance of character color.

MAP2 stores eight types of font sets. Each font set contains 256 characters of character font data that can be selected by 8-bit character codes. Each character font data item has a data size corresponding to a font pattern such as 8 dots×26 lines or 9 dots×16 lines.

Figure 3:
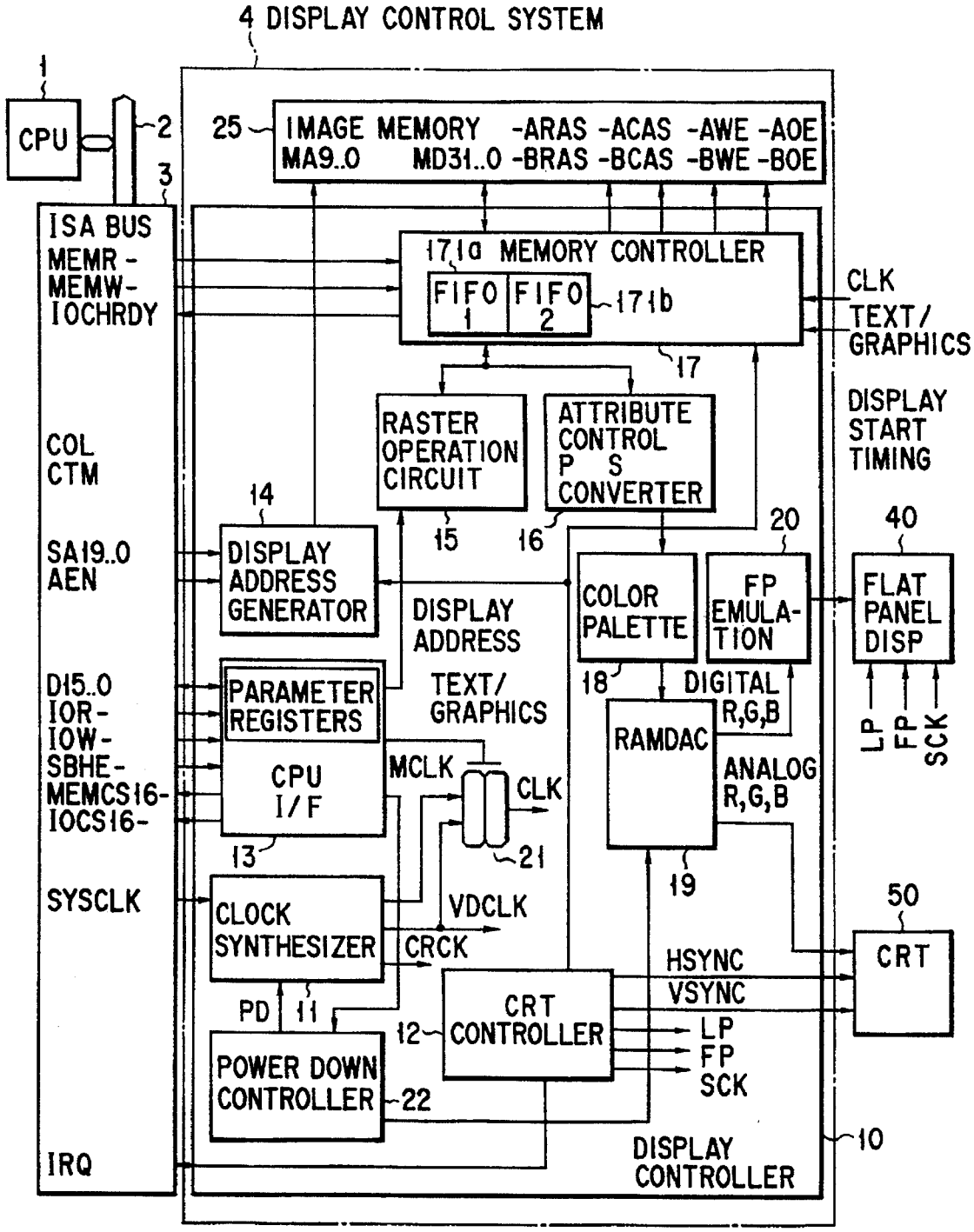
FIG. 3 is an overall block diagram of a display control system according to an embodiment of the present invention.

As shown in FIG. 3, the display controller 10 comprises a clock synthesizer 11, a CRT control circuit 12, a CPU interface 13, a display address generator circuit 14, a raster operation circuit 15, an attribute control and parallel/serial converter circuit (P/S) 16, a memory control circuit 17, a color pallet 18, a RAMDAC 19, a flat panel emulation circuit 20, a clock selector 21, and a power down control circuit 22. All the circuits except for the memory control circuit 17 in the display controller 10 operate with the timing synchronized with video clock VDLK.

Hereinafter, the function of each circuit will be described.

The clock synthesizer 11 generates video clock VDCLK, memory clock MCLK, character clock CRCK, etc. on the basis of system clock SYSCLK from the system bus 2.

The video clock VDCLK is a synchronizing clock used to output a video signal in dots to the flat panel display 40 or the CRT display 50 in synchronization with the display timing of these displays. It has a frequency of approximately 28.322 MHz, for example. The frequency of the video clock VDCLK is determined on the basis of the horizontal/vertical scanning frequency of the flat panel display 40 or CRT display 50.

The memory clock MCLK is an operating clock to the memory control circuit 17, whose frequency can be determined only by the performance of the image memory 25 and is, for example, 41.612 MHz, which is higher than that of video clock VDCLK.

The character clock CRCK is a clock outputted on a character basis. For example, when the lateral size of font data of one character is nine dots, the character clock CRCK has nine times the period of video clock VDCLK.

A plurality of PLL circuits for generating various clocks are built in the clock synthesizer 11. To each PLL circuit used to generate video clock VDCLK, the power down signal PD from the power down control circuit 22 is supplied. The power down signal PD is used to power down the PLL circuit that generates video clock VDCLK.

The CRT control circuit 12 controls the display timing of the flat panel display 40 and the CRT display 50. Specifically, the CRT control circuit 12 generates various control signals (line pulse LP, field pulse FP, and shift clock SCK) for controlling the display timing of the flat panel display 40 and other various control signals (horizontal synchronizing signal HSYNC and vertical synchronizing signal VSYNC) for controlling the display timing of the CRT display 50 on the basis of the video clock VDCLK and character clock CRCK from the clock synthesizer 11 and the timing information set in a parameter register group. The shift clock SCK to the flat panel display 40 is used as a data shift signal for shifting and loading the video data into the flat panel display 40.

The CRT control circuit 12 supplies a display start timing signal to the memory control circuit 17 and also a display address to the display address generator circuit 14. In addition, the CRT control circuit 12 produces an interrupt request signal (IRQ) to the CPU 1.

The CPU interface 13 is used to exchange system data D15-0 etc. with the CPU 1 through the system bus 2 and is provided with a parameter register group. The parameter register group holds the display modes (the text mode and the graphics mode) of the flat panel display 40 and CRT display 50 and various parameters determining display timing. These parameters are supplied from the CPU 1 in the form of system data D15-0. The reading and writing of parameters from and into the parameter registers is controlled by I/O read signal IOR and I/O write signal IOW.

The CPU interface 13 receives SBHE signal from the system bus 2 and outputs MEMCS 16 signal and IOCS 16 signal. The SBHE signal indicates the transfer of high-order byte 15-8 in system data D15-0. The MEMCS 16 signal and IOCS 16 signal are outputted at the time of execution of a 16-bit memory cycle and a 16-bit I/O cycle, respectively.

Furthermore, the CPU interface 13 outputs a mode identification signal (text/graph) indicating whether the display mode specified by the CPU 1 is the text mode (T) or the graphics mode. The mode identification signal is set to "0" when a parameter indicating the graphics mode is set in a particular register of the parameter register group, and to "1" when a parameter indicating the text mode is set in the same register. The mode identification signal is supplied to the memory control circuit 17, clock selector 21, power down control circuit 22, etc.

On the basis of system address SA19-0 from the CPU 1 or the display address from the CRT control circuit 12, the display address generator circuit 14 produces memory address MA9-0 used for read/write access to the image memory 25. In this case, memory address MA9-0 consists of a 10-bit row address and a 10-bit column address. These row and column addresses are supplied from the display address generator circuit 14 to the image memory 25 on a time-division basis.

An AEN signal supplied from the system bus 2 to the display address generator circuit 14 indicates whether system address SA19-0 is valid or invalid.

The raster operation circuit 15 has the function of transferring system data D15-0 set by the CPU 1 in the parameter register group to the memory control circuit 17 as write data and the drawing function of performing various raster operations on the display data read from the image memory 25 by the memory control circuit 17. At the time of drawing, the raster operation circuit 15 performs a logical operation on the display data read from the image memory 25 and then writes again the operation result into the image memory 25. The contents of the operation are controlled by the parameters set in the parameter register group. The drawing data from the CPU 1 is transferred through the CPU interface 13 and raster operation circuit 15 to the memory control circuit 17.

The attribute control and parallel/serial converter circuit (P/S) 16 generates data to be supplied to the color pallet 18. In the graphics mode, 32 bits (8 pixels) of graphics data simultaneously read from MAP0 to MAP3 of the image memory 25 are segmented consecutively in units of four bits/pixel by the attribute control and parallel/serial converter circuit (P/S) 16 and then these segmented data items are inputted into the color pallet 18. On the other hand, in the text mode, eight dots of the font data corresponding to a character code are read simultaneously from MAP 2 of the image memory 25 and then segmented in dots through parallel/serial conversion. Thereafter, either four bits for the foreground or four bits for the background in the attribute data are selected on the basis of the value of the font segmented in dots. The selected 4-bit data is supplied to the color pallet 18.

The memory control circuit 17 provides access control of the image memory 25 with the screen refresh timing or at the memory read/write request (MEMR and MEMW) of the CPU 1. With the timing synchronized with the input clock CLK, the memory control circuit 17 generates a write enable signal AWE, an output enable signal AOE, a row address strobe signal ARAS, and a column address strobe signal ACAS for MAP0 and MAP1 and a write enable signal BWE, an output enable signal BOE, a row address strobe signal BRAS, and a column address strobe signal BCAS for MAP2 and MAP3.

To refresh the screen, the memory control circuit 17 starts a read access to the image memory 25 by using the display start timing signal from the CRT control circuit 12 as a trigger.

When the mode identification signal indicates the graphics mode, the memory control circuit 17 effects serial access to the image memory 25 in a high-speed page mode read cycle. The graphics data read by the serial access is temporarily loaded into FIFO buffer 171*a* or 171*b* and then transferred to the attribute control and parallel/serial converter circuit 16. In this case, FIFO buffers 171*a* and 171*b* are used alternately. While the graphics data from the image memory 25 is being written into one FIFO buffer, the graphics data is read from the other FIFO buffer.

On the other hand, when the mode identification signal indicates the text mode, the memory control circuit 17 effects random access to the image memory in a single read cycle. The text data read by the random access is directly transferred to the attribute control and parallel/serial converter circuit 16 without passing through FIFO buffers 171*a* and 171*b*.

Furthermore, the memory control circuit 17 controls the arbitration between the screen refreshing and the drawing process of the CPU. When the read access for screen refreshing collides with the read/write request (MEMR or MEMW) from the CPU 1, the memory control circuit 17 generates an I/O channel ready signal (IOCHRDY) to elongate the bus cycle of the CPU 1.

The color pallet control circuit 18 determines the color attributes of the 4-bit/pixel data outputted from the attribute control and parallel/serial converter circuit (P/S) 16, and is provided with a color pallet table containing 16 color pallet registers. The 4-bit/pixel data is inputted as index from the attribute control and parallel/serial converter circuit (P/S) 16 to the color pallet table, and one of the 16 color pallet registers is selected. Six bits of color pallet data are set in each color pallet register. The 6-bit color pallet data read from the selected color pallet register has added there to the two bits outputted from a color select register built in the color pallet control circuit 18, and then a total of eight bits of data are outputted. The 8-bit data is supplied as CRT video data to the RAMDAC 19.

The RAMDAC 19 produces R, G, and B analog color video signals for the color CRT display 50, and comprises a color table using 8-bit CRT video data as index and a D/A converter for converting the color data read from the color table into an analog signal. Since the VGA specifications include a display mode in which 256 colors are displayed simultaneously, the color table contains 256 color registers to support this display mode, one of which is selected by the CRT video data. Each color register stores a total of 18 bits of color data for R, G, and B, each consisting of six bits. The color data stored in the selected color register supplied as digital R, G, and B data to the flat panel emulation circuit 20 and also to a D/A converter built in the RAMDAC 19. The D/A converter converts the digital R, G, and B data into analog R, G, and B signals and supplies these signals to the CRT display 50.

The flat panel emulation circuit 20, using the digital R, G, and B data, emulates the color or monochrome gradation video data for the flat panel display 40.

The clock selector 21 selects one of memory clock MCLK and video clock VDCLK as an input clock CLK to the memory control circuit 17. In this case, the select operation of the clock selector 21 is controlled by the mode identification signal from the CPU interface 13. Specifically, when the mode identification signal is at level "0" indicating the graphics mode, memory clock MCLK is selected; when the mode identification signal is at level "1" indicating the text mode, video clock VDCLK is selected.

The power down circuit 22 generates a power down signal PD when it is sensed from the mode identification signal that the graphics mode is switched to the text mode. The power down signal PD disables the PLL for generating memory clock MCLK in the clock synthesizer 11 to power it down. In addition, the power down control circuit 22 stops generating the power down signal PD in order to enable the PLL for generating memory clock MCLK when it is sensed from the mode identification signal that the text mode is switched to the graphics mode. Furthermore, the power down control circuit 22 provides power down control of RAMDAC 19. Disable control for a power down operation can be effected by the technique of cutting off the supply of power or an operating clock to the circuit, for example.

With the display control system 4, when the display mode is switched from the graphics mode to the text mode, the input clock CLK to the memory control circuit 17 is switched from the memory clock MCLK to the video clock VDCLK, and also the mode in which the memory control circuit 17 accesses the image memory 25 is switched from a serial access using a high-speed page-mode read cycle to a random access using a single read cycle.

Specifically, in the graphics mode, the memory control circuit 17 operates in synchronization with memory clock MCLK faster than video clock VDCLK and thereby provides access control of the image memory 25 with the timing synchronized with the memory clock MCLK. A read access to the image memory 25 is performed in a high-speed page-mode read cycle and then the graphics data consecutively stored in address order in MAP0 to MAP3 Of the image memory 25 is read serially. The read-out graphics data is written into FIFO buffer 171*a*. When the FIFO buffer 171*a* gets full, the graphics data then starts to be written into FIFO buffer 171*b*. At the same time, the graphics data is read from the FIFO buffer 171*a* and sent to the attribute control and parallel/serial converter circuit 16.

On the other hand, in the text mode, since the memory control circuit 17 operates in synchronism with video clock VDCLK, the entire video controller 10 functions as a video clock VDCLK synchronizing circuit. A read access to the image memory 25 is executed in a single read cycle.

Specifically, when a parameter specifying the text mode is set in a particular register of the parameter register group by the CPU 1, the mode identification signal is set to "1" indicting the text mode. The clock selector 21 responds to the "1" mode identification signal, and switches the input clock CLK to the memory control circuit 17 from memory clock MCLK to video clock VDCLK. Furthermore, the power down control circuit 22 responds to the "1" mode identification signal and then generates a power down signal PD, thereby powering down the PLL for generating the memory clock MCLK of the clock synthesizer 11.

In response to the "1" mode identification signal, the mode in which the memory control circuit 17 accesses the image memory is switched from the high-speed page mode to the single read mode. In this case, the memory control circuit 17 generates control signals including RAS and CAS with the timing synchronizing with video clock VDCLK and supplies these signals to the image memory 25, thereby performing random access to the image memory 25 character by character.

Hereinafter, referring to FIG. 4 and FIGS. 5A through 5P, an access to the image memory in the text mode will be described in detail.

Figure 4:
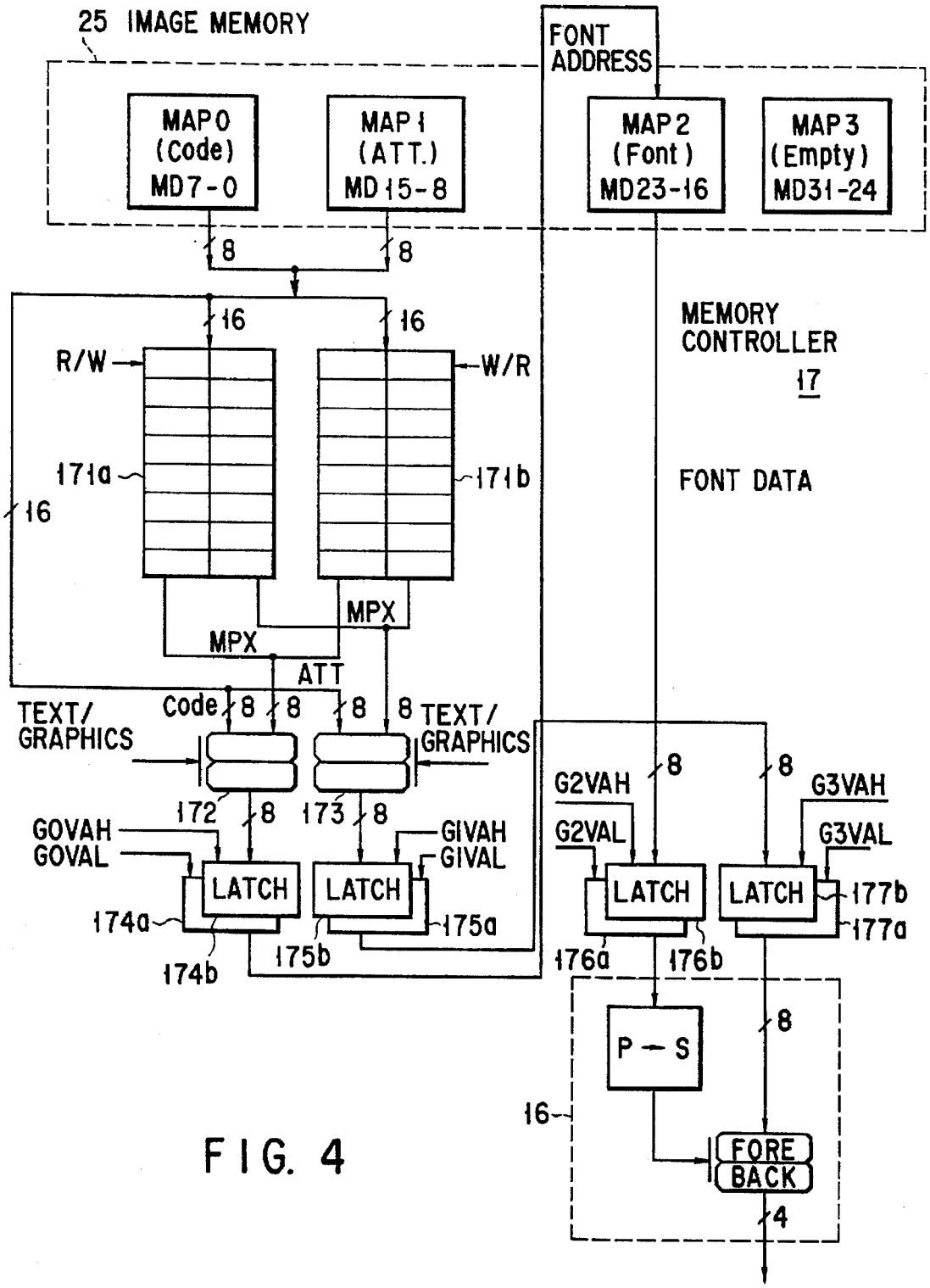
FIG. 4 is a circuit diagram of a memory control circuit provided in the embodiment.
Figure 5:
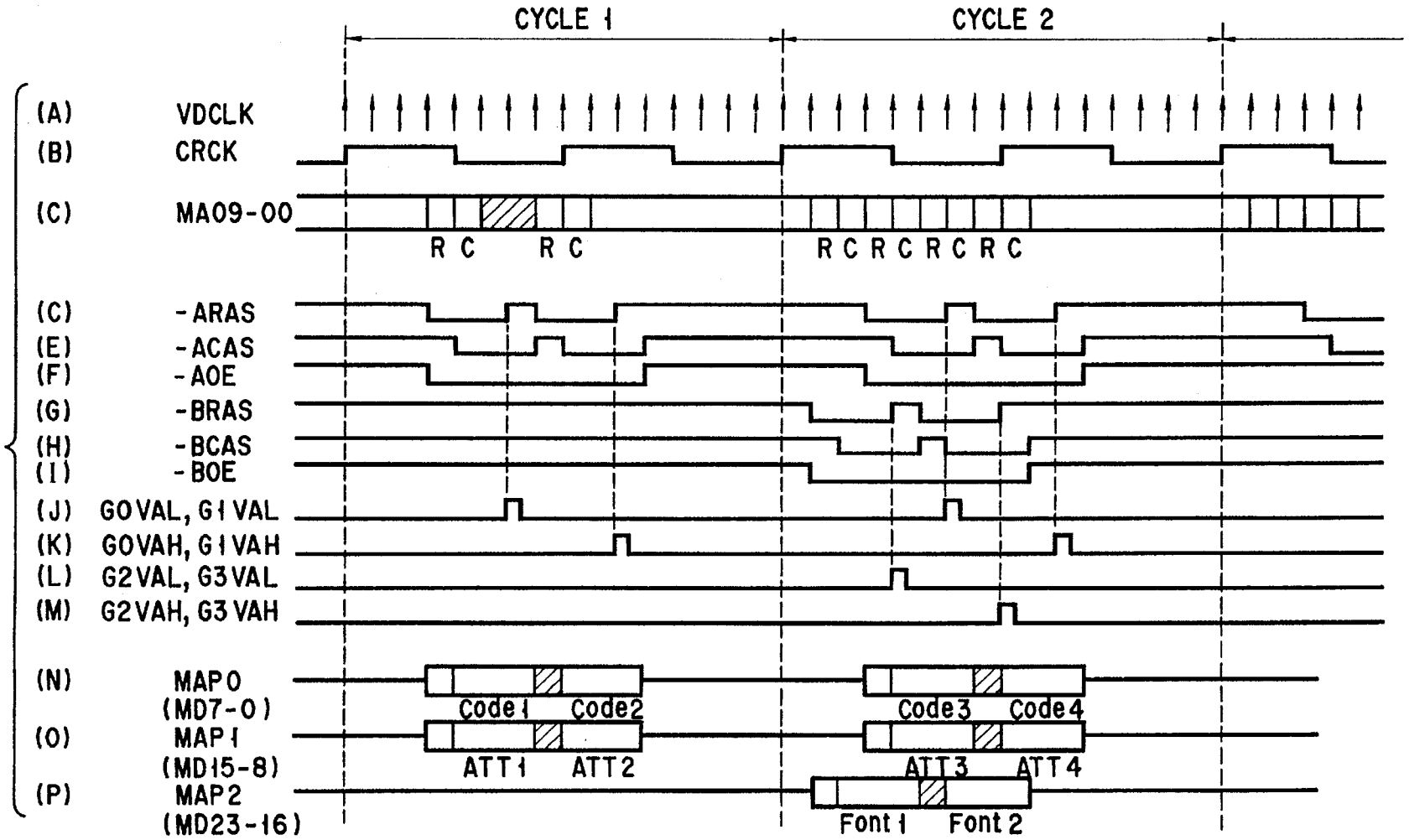
FIG. 5 is a timing chart to help explain a data read operation in the text mode in the embodiment.

FIG. 4 shows an arrangement of the memory control circuit 17 conceptually. FIGS. 5A through 5P are timing charts of the access timing of the image memory in the text mode.

In the text mode, of the four maps (MAP0 to MAP3) constituting the image memory 25, MAP0, MAP1, and MAP2 are used, and MAP3 is not used. MAP0 stores character codes (Code), MAP1 stores attributes (ATT), and MAP2 stores character fonts (Font).

When the text data is displayed, MAP0 and MAP1 of the image memory 25 are first accessed in a single read cycle. In this page-mode read cycle, a single column address CA is generated for a single row address RA, and then supplied to MAP0 and MAP1. As a result, the character code for a character is read from MAP0, and the attribute corresponding to the character code is read from MAP1. These character code and attribute are latched in latch circuits 174*a* and 1754*a* by way of multiplexers 172 and 173, respectively. The timing at that time is shown in FIGS. 5A through 5P.

Specifically, according to the same ACAS and ARAS, MAP0 and MAP1 are accessed in common. The character code (Code1) and attribute (ATT1) read simultaneously from MAP0 and MAP1 are latched with the timing of latch signals G0VAL and G1VAL.

After such a single access has been performed twice, the character codes (Code1 and Code2) for two characters are latched in the latch circuits 174*a* and 174*b*, respectively. Similarly, the attributes (ATT1 and ATT2) for two characters are latched in the latch circuits 175*a* and 175*b*, respectively.

Thereafter, in the next cycle, the character codes (Code3 and Code 4) for a third and a fourth character and the attributes (ATT3 and ATT4) corresponding to these codes are read from MAP0 and MAP1. In this case, before an access to MAP for the third character, a single read access to MAP2 is effected using the character code (Code1) for the first character as a font address.

In the single read access, the row address RA and column address CA corresponding to the font address are supplied to MAP2 with the timing of BCAS and BRAS. As a result, the font data (Font1) equivalent to a raster of the character font pattern specified at the font address is read from MAP2 and then latched in the latch circuit 176*a* with the timing of the latch signal G2VAL. At the same time, the attribute (ATT1) for the first character is latched in the latch circuit 177a with the timing of the latch signal G3VAL.

Thereafter, in the interval between accesses to MAP0 and MAP1 for the third and the fourth character, a single read access to MAP2 using the character code (Code 2) for the second character as a font address is performed.

Then, the font data (Font 2) is read and then latched in the latch circuit 176*b* with the timing of the latch signal G2VAH. At the same time, the attribute (ATT2) for the second character is latched in the latch circuit 177*b* with the timing of the latch signal G3VAH.

In this way, for the second and later cycles, in the intervals between read accesses to MAP0 and MAP1 for character codes and attributes, a read access to MAP2 for fonts is inserted, thereby executing a read access for character codes and attributes and a read access for fonts in parallel on a time-division basis.

For example, when it is assumed that four characters of text data are read from the image memory 25, three cycles ranging from cycle 1 to cycle 3 are needed. As seen from the timing charts of FIGS. 5A through 5P, in cycle 2, the time required to read the data from the image memory 25 is as long as eight periods of video clock VDCLK. Similarly, also in cycle 3, eight periods of video clock VDCLK are used for data reading. In cycle 1, the time required to read the data from the image memory 25 is as long as two periods of video clock VDCLK. Consequently, the actual time that the image memory 25 is occupied to read four characters of text data is as long as 20 periods of video clock VDCLK.

Therefore, it is possible to shorten the actual time that the image memory 25 is occupied than when a page-mode read cycle is used, which thereby increases the time that control of the image memory 25 can be passed to the CPU 1.

Because the memory control circuit 17 operates in synchronism with video clock VDCLK, the entire display controller 10 functions as a video clock synchronizing circuit. This causes the timing of reading data from the image memory 25 to coincide with the display operation timing, which makes it unnecessary to provide a data buffer etc. for synchronization, thereby leading to simplified control.

Hereinafter, using concrete values, the drawing time of CPU 1 in the text mode will be calculated.

Here, how many times the memory cycle for CPU 1 can be inserted during the period of time during which four characters of text data are read from the image memory 25 is examined.

Figure 6:
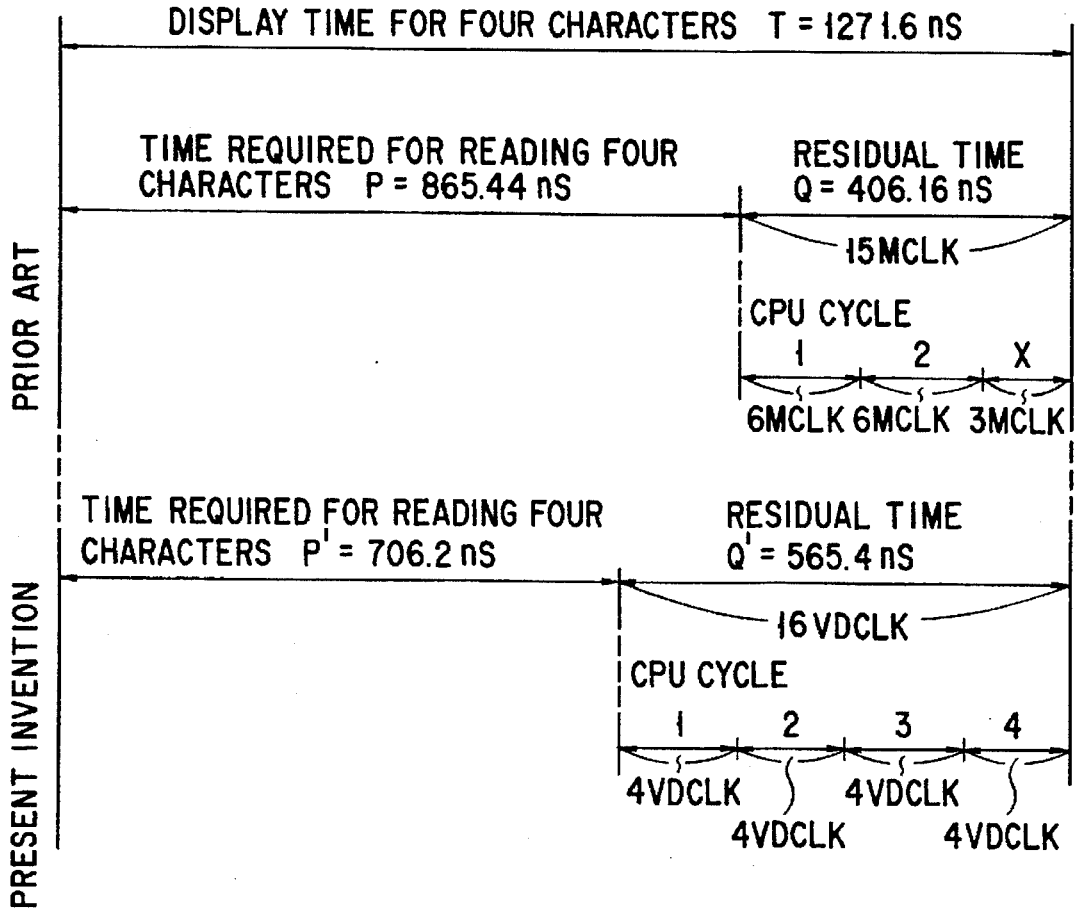
FIG. 6 is a diagram to help explain how many times a CPU cycle can be inserted in the embodiment.

As shown in FIG. 6, if the lateral size of a character=nine dots and the period of VDLK=35.31 ns, the time T required to display four characters of text data will be expressed by:

$$T = 9 \times 4 \times VDCLK = 36 \times 35.31 \text{ ns} = 1271.6 \text{ ns}$$

Figure 2:
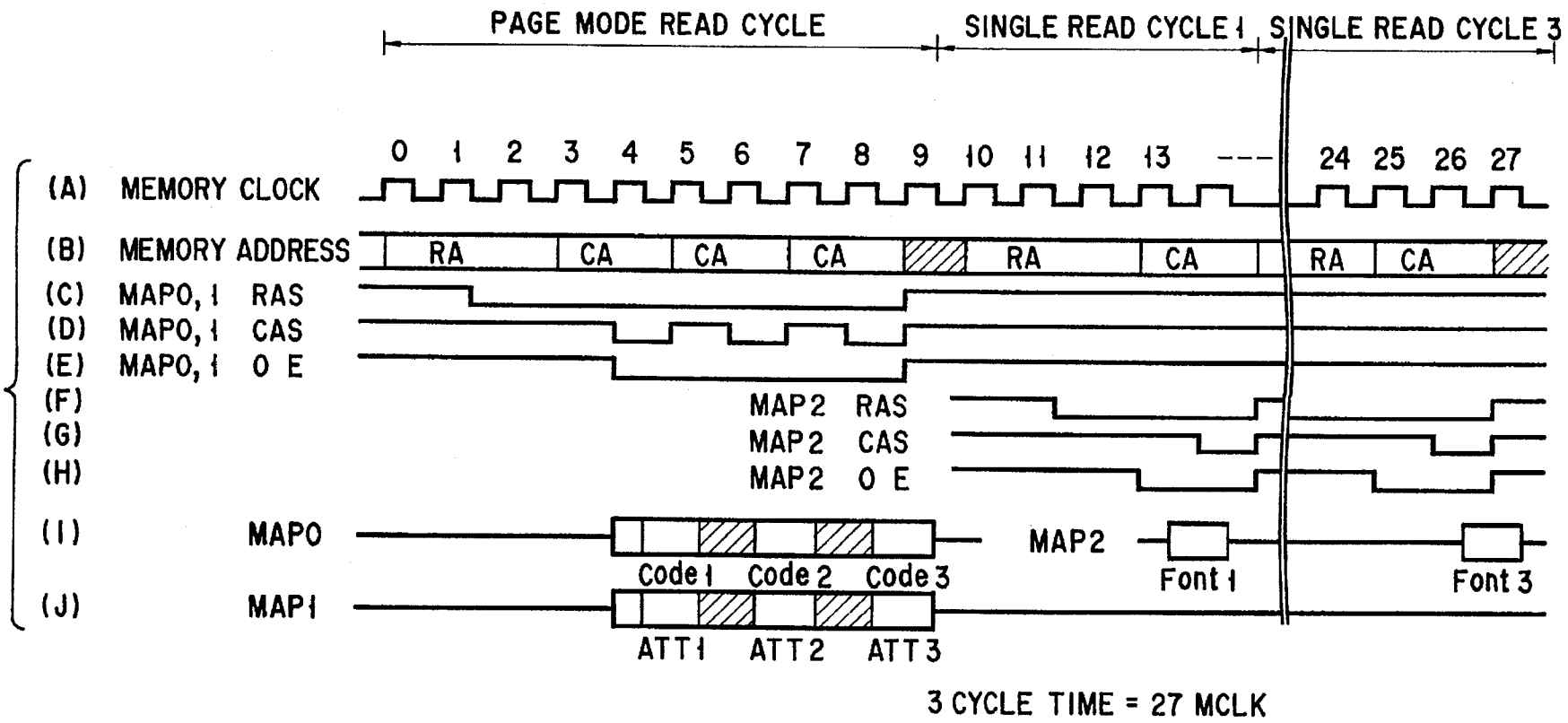
FIG. 2 (PRIOR ART)
FIG. 2 is a timing chart to help explain a data read operation in the test mode in the conventional display control system.

With a conventional technique of using the page-mode read cycle explained in FIGS. 1 and 2, it is necessary to read the character codes and attributes for four characters and the fonts for four characters. Therefore, if the period of memory clock MCLK is 24.04 ns, the time p required to read four characters of text data (character codes and attributes) and the fonts for four characters from the image memory 25 is expressed as:

$$P = 9 \times 4 \times MCLK = 36 \times 24.04 \text{ ns} = 865.44 \text{ ns}$$

In this case, the remaining time Q is given by:

$$Q = T - P = 406.16 \text{ ns}$$

The remaining time Q is equivalent to 15 periods of memory clock MCLK. A single CPU cycle requires six periods of memory clocks MCLK. As a result, the number of CPU cycles executable during the remaining time is two cycles.

On the other hand, in the embodiment, as described earlier, since the time P' required to read four characters of text data has only to be 20 periods of video clock VDCLK, it follows that:

$$P' = 20 \times VDCLK = 20 \times 35.31 \text{ ns} = 706.2 \text{ ns}$$

In this case, the remaining time Q' is given by:

$$Q' = T - P' = 565.4 \text{ ns}$$

The remaining time Q' is equivalent to 16 periods of video clock VDCLK. Since the period of video clock VDCLK is longer than that of memory clock MCLK, the time required for a single CPU cycle has only to be a period of time equivalent to four periods of video clock VDCLK. Thus, the number of CPU cycles executable during the remaining time Q' is four cycles.

While in the embodiment, in cycle 2 and later, the font for the first character is read before the reading of character codes and attributes, use of a three-stage latch circuit may enable the font for the first character to be read after the reading of the character code and attribute for the third character.

Furthermore, while in the embodiment, video clock VDCLK is used in the text mode, memory clock MCLK may be used directly to access the image memory 25 without switching clocks.

In this case, since nearly 20 periods of memory clock MCLK are necessary to read four characters of text data, the time P" required for reading is represented as:

$$P'' = 20 \times MCLK = 20 \times 24.04 \text{ ns} = 480.8 \text{ ns}$$

The remaining time Q" is given by:

$$Q'' = T - P'' = 790.8 \text{ ns}$$

The remaining time Q" is equivalent to 32 periods of memory clock MCLK. Since the time required for a single CPU cycle is six periods of memory clock MCLK, the number of CPU cycles executable during the remaining time Q" is five cycles.

Accordingly, it is possible to make much shorter the time required to read character codes, attributes, and fonts from the image memory 25. In this case, however, because two types of clock are used as in the graphics mode, it is necessary to carry out synchronizing control by using a data buffer such as the FIFO.

While in the embodiment, the dynamic RAM is used as the image memory 25, the image memory 25 may be made up of a dual port VRAM with a random access port and a serial access port.

In this case, in the text mode, the random access port of the dual port VRAM is used for the CPU 1 to draw pictures as well as for font reading, and the serial access port is used to read character codes and attributes. All the access control of dual port VRAM is effected with the timing synchronizing with video clock VDCLK.

On the other hand, in the graphics mode, the random access port of dual port VRAM is used for the CPU 1 to draw pictures, and the serial access port is used to read graphics data. All the access control of dual port VRAM is performed with the timing synchronizing with memory clock MCLK.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A display control system comprising:

an image memory storing either text data and character fonts or graphics data;

display mode discriminating means for discriminating whether the display mode specified by a host CPU is a graphics mode or a text mode;

memory control means for providing access control of said image memory with the timing synchronized with an input clock, an operation of which is controlled on the basis of the discrimination result of said display mode discriminating means and for, in the graphics mode, executing a serial access in a page mode to consecutively read a plurality of graphics data items stored in address order in said image memory, and in the text mode, executing a random access to alternately read the text data items and character fonts stored in said image memory;

video clock generator means for producing a video clock synchronized with the display timing of a display;

memory clock generator means for generating a memory clock a frequency of which is higher than that of the video clock;

display control means for convering the data read from said image memory into video data with the timing synchronized with the video clock and outputting the video data to a display; and clock selecting means, controlled on the basis of the discrimination result of said display mode discriminating means, for, in the graphics mode, supplying the memory clock from said memory clock generator means as an input clock to said memory control means, and in the text mode, supplying the video clock from said video clock generator means as an input clock to said memory control means.

2. The system according to claim 1 further comprising means, controlled on the basis of the judgment result of said display mode discriminating means, for powering down said memory clock means in the text mode.

3. The system according to claim 1, wherein said image memory is implemented by a dynamic RAM.

4. The system according to claim 1, wherein said image memory is implemented by a video RAM with a random access port and a serial access port, and said memory control means, in the graphics mode, effects serial access to said video RAM via said serial access port and, in the text mode, effects random access to said video RAM via said random access port.

5. A display control system comprising:

an image memory storing either text data and character fonts or graphics data;

display mode discriminating means for discriminating whether the display mode specified by a host CPU is a graphics mode or a text mode;

memory control means, provided with a first-in first-out (FIFO) buffer, for providing access control of said image memory with the timing synchronized with an input clock, an operation of which is controlled on the basis of the discrimination result of said display mode discriminating means and for, in the graphics mode, executing a serial access in a page mode to consecutively read a plurality of graphics data items stored in address order in said image memory, and in the text mode, executing a random access to alternately read the text data items and character fonts stored in said image memory, the text data read through the random access being bypassed through the FIFO buffer and supplied to display control means;

video clock generator means for producing a video clock synchronized with the display timing of a display;

memory clock generator means for generating a memory clock a frequency of which is higher than that of the video clock;

display control means for converting the data read from said image memory into video data with the timing synchronized with the video clock and outputs the video data to a display;

clock selecting means, controlled on the basis of the discrimination result of said display mode discriminating means, for, in the graphics mode, supplying the memory clock from said memory clock generator means as an input clock to said memory control means, and in the text mode, supplying the video clock from said video clock generator means as an input clock to said memory control means.

6. The system according to claim 5, wherein said memory control means random-accesses said image memory by supplying the video clock to said image memory only in a read operation in the text mode, and serial-accesses said image memory in the page mode by supplying the memory clock to said image memory in a write operation in the text mode.

7. A display control system comprising:

an image memory storing either text data and character fonts or graphics data;

display mode discriminating means for discriminating whether the display mode specified by a host CPU is a graphics mode or a text mode;

memory control means for providing access control of said image memory with the timing synchronized with an input clock, an operation of which is controlled on the basis of the discrimination result of said display mode discriminating means and for, in the graphics mode, executing a serial access in a page mode to consecutively read a plurality of graphics data items stored in address order in said image memory, and in the text made, executing a random access to alternately read the text data items and character fonts stored in said image memory, the memory control means random-accessing the image memory by supplying the video clock to the image memory only in a read operation in the text mode, and serial-accessing the image memory in the page mode by supplying the memory clock to the image memory in write operation in the text mode;

video clock generator means for producing a video clock synchronized with the display timing of a display;

memory clock generator moans for generating a memory clock, a frequency of which is higher than that of the video clock;

display control means for converting the data read from said image memory into video data with the timing synchronized with the video clock and outputting the video data to a display; and clock selecting means, controlled on the basis of the discrimination result of said display mode discriminating means, for, in the graphics mode, supplying the memory clock from said memory clock generator means as an input clock to said memory control means, and in the text mode, supplying the video clock from said video clock generator means as an input clock to said memory control means.

8. A display control system comprising:

an image memory storing either text data and character fonts or graphics data;

display mode discriminating means for discriminating whether the display mode specified by a host CPU is a graphics mode or a text mode;

memory control means, provided with a first-in first-out (FIFO) buffer, for providing access control of said image memory with the timing synchronized with an input clock, an operation of which is controlled on the basis of the discrimination result of said display mode discriminating means and for, in the graphics mode, executing a serial access in a page mode to consecutively read a plurality of graphics data items stored in address order in said image memory, and in the text mode, executing a random access to alternately read the text data items and character fonts stored in said image memory;

video clock generator means for producing a video clock synchronized with the display timing of a display;

memory clock generator means for generating a memory clock, a frequency of which is higher than that of the video clock;

display control means for converting the data read from said image memory into video data with the timing synchronized with the video clock and outputting the video data to a display;

selecting means for receiving the graphics data read from the image memory and through the FIFO buffer and the text data read from the image memory and not through the FIFO buffer, and for selecting one of the graphics data and the text data in accordance with the discrimination by the display mode discriminating means; and clock selecting means, controlled on the basis of the discrimination result of said display mode discriminating means, for, in the graphics mode, supplying the memory clock from said memory clock generator means as an input clock to said memory control means, and in the text mode, supplying the video clock from said video clock generator means as an input clock to said memory control means.

* * * * *